US007342387B1

(12) United States Patent
Li

(10) Patent No.: US 7,342,387 B1
(45) Date of Patent: Mar. 11, 2008

(54) SYSTEM AND METHOD FOR PROVIDING A HIGHLY EFFICIENT WIDE BANDWIDTH POWER SUPPLY FOR A POWER AMPLIFIER

(75) Inventor: Yushan Li, Longmont, CO (US)

(73) Assignee: National Semiconductor Corporation, Santa Clara, CA (US)

( * ) Notice: Subject to any disclaimer, the term of this patent is extended or adjusted under 35 U.S.C. 154(b) by 374 days.

(21) Appl. No.: 11/065,255

(22) Filed: Feb. 24, 2005

(51) Int. Cl.
*G05F 1/40* (2006.01)
*G05F 1/56* (2006.01)

(52) U.S. Cl. ..... 323/282; 323/271

(58) Field of Classification Search ..... 323/268, 323/270, 271, 273, 275, 279, 282, 285, 290; 330/127, 199, 277, 291, 296, 297
See application file for complete search history.

(56) References Cited

U.S. PATENT DOCUMENTS 6,188,212 B1 * 2/2001 Larson et al. ..... 323/281
6,646,511 B2 11/2003 Canyon et al.
6,701,138 B2 3/2004 Epperson et al.
6,757,526 B1 6/2004 Sharp et al.
6,759,836 B1 * 7/2004 Black, Jr. ..... 323/288
6,788,141 B2 9/2004 Paul et al.
6,897,637 B2 * 5/2005 Chen et al. ..... 323/274
6,963,196 B2 * 11/2005 Mende ..... 324/117 H
7,030,595 B2 * 4/2006 Akita ..... 323/280

* cited by examiner

*Primary Examiner*—Matthew V. Nguyen

(57) ABSTRACT

A system and a method are disclosed for providing a highly efficient wide bandwidth power supply for a power amplifier. A power supply control circuit of the invention comprises a wide bandwidth low drop out (LDO) circuit and a highly efficient switcher circuit. The switcher circuit comprises a switcher control circuit that receives an $I_{LDO}$ current signal from the low drop out (LDO) circuit and an $I_{SWITCHER}$ current signal from the switcher circuit. The switcher control circuit uses the $I_{LDO}$ value and the $I_{SWITCHER}$ value to control an amount of current that is provided by the switcher circuit. The $I_{LDO}$ current from the low drop out (LDO) circuit and the $I_{SWITCHER}$ current from the switcher circuit are used to control a supply voltage $V_{CC}$ that is provided to a power amplifier.

19 Claims, 10 Drawing Sheets

SYSTEM AND METHOD FOR PROVIDING A HIGHLY EFFICIENT WIDE BANDWIDTH POWER SUPPLY FOR A POWER AMPLIFIER

TECHNICAL FIELD OF THE INVENTION

The present invention is generally directed to the manufacture of power supplies for semiconductor circuits and, in particular, to a system and method for providing a highly efficient wide bandwidth power supply for a power amplifier.

BACKGROUND OF THE INVENTION

The telecommunications industry continually attempts to improve the transmitter circuitry in wireless communication systems. Power amplifier (PA) circuitry is a major component of a transmitter of a wireless communication device. Power amplifier (PA) circuitry provides the power for transmitting a signal (including data modulated and carried by the signal) so that a base station or a receiver can receive the signal.

Power amplifier (PA) circuitry uses a large amount of power. The power amplifier (PA) module is one of the most power consuming components of a wireless communication device. Therefore it is very desirable to provide power amplifier (PA) circuitry that is power efficient.

One method for improving power amplifier (PA) efficiency is to use a drain/collector modulation technique. In the drain/collector modulation technique a non-linear high efficiency power amplifier can be used (e.g., a class C power amplifier) instead of a linear low efficiency power amplifier (e.g., a class A amplifier). The power control of the power amplifier (PA) circuitry is achieved by adjusting the power amplifier (PA) power supply $V_{CC}$. A high efficiency power supply combined with a high efficiency power amplifier (PA) (with constant bias) would be ideal.

In prior art power amplifier (PA) modules in GSM (Global System for Mobile Communications) telecommunication devices such as RF3110 (manufactured by RFMD) and TQM7M4014 (manufactured by Triquint), the power amplifier (PA) power supply $V_{CC}$ is from a linear regulator or "low-drop-out" (LDO) circuit. An LDO circuit can have a high efficiency when the value of its output voltage ($V_{CC}$) is near the value of its input voltage ($V_{BATT}$). But an LDO circuit will have a very low efficiency when its output voltage ($V_{CC}$) is very low compared with its input voltage ($V_{BATT}$).

The maximum efficiency for an LDO circuit is the ratio of the output voltage $V_{CC}$ to the input voltage $V_{BATT}$. That is, the maximum efficiency is given by the ratio $V_{CC}/V_{BATT}$. For example, the maximum efficiency for an LDO in a typical GSM handset with an output voltage of nine tenths volts ($V_{CC}$=0.9 volts) and an input voltage of three and six tenths volts ($V_{BATT}$=3.6 volts) is twenty five percent (25%).

One method for increasing the efficiency of the power amplifier (PA) power supply $V_{CC}$ is to use a switching converter. Presently existing switching converters, however, are designed to provide a constant output voltage. These converters are called "DC/DC converters" because they operate with direct current (DC) in and direct current (DC) out. DC/DC converters switch from a few hundred kilohertz (kHz) to a few megahertz (MHz) with a loop unit gain bandwidth having a range of approximately one hundred kilohertz (100 kHz).

On the other hand, GSM power amplifiers (PAs) require the supply voltage $V_{CC}$ to be able to follow the input voltage ramp signal ($V_{ramp}$) with very high accuracy. In a GSM system, the $V_{ramp}$ signal is required to slew from zero to its maximum value in ten microseconds (10 μs) to twenty microseconds (20 μs). This means that the supply voltage $V_{CC}$ must be able to slew from zero to approximately three and seven tenths volts (3.7 V) in ten microseconds (10 μs) to twenty microseconds (20 μs) and follow the $V_{ramp}$ signal in the close loop fashion with the power amplifier (PA) load. There are presently no switching converters available that can provide this level of performance.

Therefore, there is a need in the art for a system and method that is capable of providing a highly efficient wide bandwidth power supply for a power amplifier.

SUMMARY OF THE INVENTION

To address the above-discussed deficiencies of the prior art, it is a primary object of the present invention to provide a system and method for providing an improved power supply control circuit that is capable of providing a highly efficient wide bandwidth power supply for a power amplifier.

One advantageous embodiment of the power supply control circuit of the invention comprises a low drop out (LDO) circuit and a switcher circuit that are coupled through an inductor. The power supply control circuit of the invention provides to a power amplifier a power control signal that has high efficiency and a wide bandwidth. The wide bandwidth is provided by the low drop out (LDO) circuit and the high efficiency is provided by the switcher circuit.

The switcher circuit comprises a switcher control circuit that receives an $I_{LDO}$ current signal from an $I_{LDO}$ current probe within the low drop out (LDO) circuit. The switcher control circuit also receives an $I_{SWITCHER}$ current signal from an $I_{SWITCHER}$ current probe within the switcher circuit. The switcher control circuit uses the values of the $I_{LDO}$ current signal and the $I_{SWITCHER}$ current signal to control an amount of current that is provided by the switcher circuit. The $I_{LDO}$ current from the low drop out (LDO) circuit and the $I_{SWITCHER}$ current from the switcher circuit are used to control a supply voltage $V_{CC}$ that is provided to a power amplifier.

In one embodiment of the invention the functions of the switcher control circuit are implemented using a hysteretic current mode control technique. In another embodiment of the invention the functions of the switcher control circuit are implemented using a pulse width modulation (PWM) current mode control technique. In yet another embodiment of the invention the functions of the switcher control circuit are implemented using a technique that utilizes either a "constant on" time period or a "constant off" time period.

It is an object of the present invention to provide a system and method for providing an improved power supply control circuit that is capable of providing a highly efficient wide bandwidth power supply for a power amplifier.

It is also an object of the present invention to provide a system and method for providing an improved power supply control circuit that comprises a low drop out (LDO) circuit and a switcher circuit.

It is yet another object of the present invention to provide a system and method for an improved power supply control circuit that comprises a low drop out (LDO) circuit, a switcher circuit, and a switcher control circuit for controlling an output current of the switcher circuit.

It is another object of the present invention to provide a switcher control circuit in an improved power supply control circuit that comprises a low drop out (LDO) circuit and a switcher circuit in which the switcher control circuit operates using a hysteretic current mode control technique.

It is also another object of the present invention to provide a switcher control circuit in an improved power supply control circuit that comprises a low drop out (LDO) circuit and a switcher circuit in which the switcher control circuit operates using a pulse width modulation (PWM) current mode control technique.

It is yet another object of the present invention to provide a switcher control circuit in an improved power supply control circuit that comprises a low drop out (LDO) circuit and a switcher circuit in which the switcher control circuit operates using a technique that utilizes either a "constant on" time period or a "constant off" time period.

The foregoing has outlined rather broadly the features and technical advantages of the present invention so that those skilled in the art may better understand the detailed description of the invention that follows. Additional features and advantages of the invention will be described hereinafter that form the subject of the claims of the invention. Those skilled in the art should appreciate that they may readily use the conception and the specific embodiment disclosed as a basis for modifying or designing other structures for carrying out the same purposes of the present invention. Those skilled in the art should also realize that such equivalent constructions do not depart from the spirit and scope of the invention in its broadest form.

Before undertaking the Detailed Description of the Invention below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior uses, as well as future uses, of such defined words and phrases.

BRIEF DESCRIPTION OF THE DRAWINGS

For a more complete understanding of the present invention and its advantages, reference is now made to the following description taken in conjunction with the accompanying drawings, in which like reference numerals represent like parts.

DETAILED DESCRIPTION OF THE INVENTION

Figure 1:
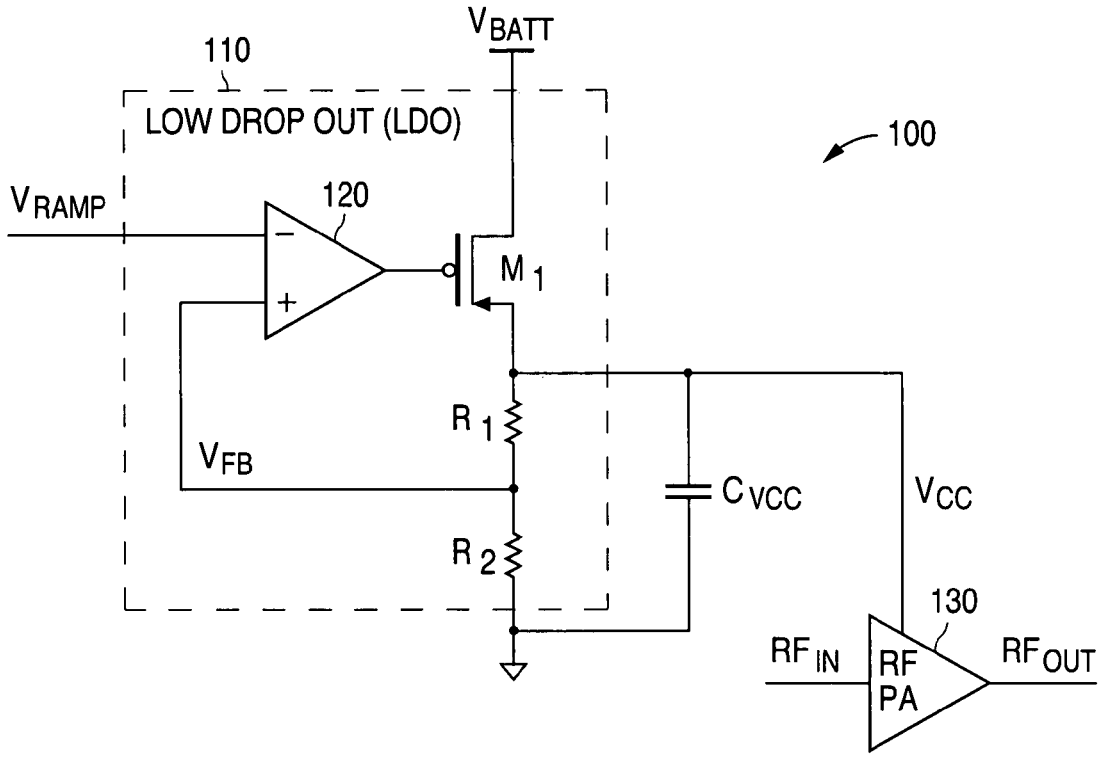
FIG. 1 (PRIOR ART)
FIG. 1 illustrates a schematic diagram of a prior art power supply control circuit.

FIGS. 1 through 9 and the various embodiments used to describe the principles of the present invention in this patent document are by way of illustration only and should not be construed in any way to limit the scope of the invention. Those skilled in the art will understand that the principles of the present invention may be implemented in any type of suitably arranged power amplifier circuit.

To simplify the drawings the reference numerals from previous drawings will sometimes not be repeated for structures that have already been identified.

FIG. 1 illustrates a schematic diagram of a prior art power supply control circuit 100. Power supply control circuit 100 comprises a low drop out (LDO) circuit 110. Low drop out (LDO) circuit 110 comprises an operational amplifier 120 that receives a $V_{ramp}$ signal on its inverting input. A feedback voltage signal $V_{FB}$ is provided to the non-inverting input of operational amplifier 120. The operating voltage for low drop out (LDO) circuit 110 is provided by $V_{BATT}$.

The output of low drop out (LDO) circuit 110 is the power amplifier (PA) power supply voltage $V_{CC}$. Power supply voltage $V_{CC}$ is provided to radio frequency (RF) power amplifier (PA) 130. Radio frequency (RF) power amplifier (PA) 130 amplifies an RF input signal ($RF_{IN}$) to generate an amplified RF output signal ($RF_{OUT}$).

Figure 2:
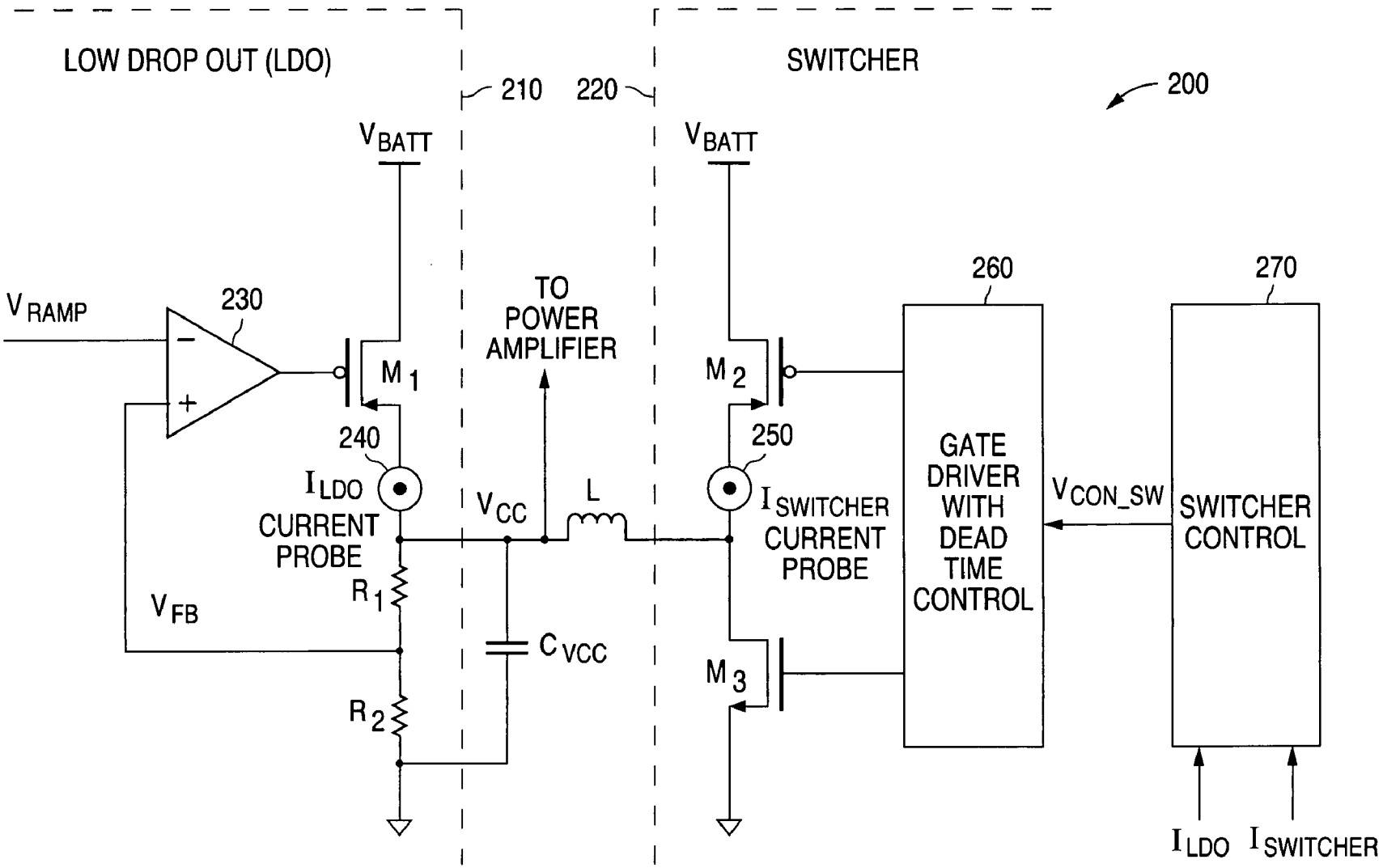
FIG. 2 illustrates a schematic diagram of a first embodiment of a combination of a low drop out circuit and a switcher circuit in accordance with the principles of the present invention.

FIG. 2 illustrates a schematic diagram of a first embodiment of a power supply control circuit 200 that comprises a low drop out circuit 210 and a switcher circuit 220 in accordance with the principles of the present invention. As will be more fully described, the switcher circuit 220 is controlled by a current $I_{LDO}$ that is present in the low drop out circuit 210 and a current $I_{SWITCHER}$ that is present in the switcher circuit 220.

Power supply control circuit 200 comprises a low drop out (LDO) circuit 210. Low drop out (LDO) circuit 210 comprises an operational amplifier 230 that receives a $V_{ramp}$ signal on its inverting input. A feedback voltage signal $V_{FB}$ is provided to the non-inverting input of operational amplifier 230. The operating voltage for low drop out (LDO) circuit 210 is provided by $V_{BATT}$.

The output of operational amplifier 230 is provided to the gate of a PMOS transistor $M_1$. The drain of PMOS transistor $M_1$ is coupled to the operating voltage $V_{BATT}$. The source of PMOS transistor $M_1$ is coupled to a first end of an $I_{LDO}$ current probe 240. The $I_{LDO}$ current probe 240 detects and measures the current that is present in the source of PMOS transistor $M_1$.

The second end of $I_{LDO}$ current probe 240 is coupled to a first end of a resistor $R_1$. The second end of resistor $R_1$ is coupled to a first end of a resistor $R_2$. The second end of resistor $R_2$ is coupled to ground. The feedback voltage signal $V_{FB}$ that is provided to the non-inverting input of operational amplifier 230 is taken from a point located between resistor $R_1$ and resistor $R_2$.

The output of low drop out (LDO) circuit 210 is the power amplifier (PA) power supply voltage $V_{CC}$. The power supply voltage $V_{CC}$ is taken from a point located between the $I_{LDO}$ current probe 240 and resistor $R_1$. Power supply voltage $V_{CC}$ is provided to a radio frequency (RF) power amplifier (PA) (not shown in FIG. 2). Capacitor $C_{VCC}$ is coupled in parallel with the series combination of resistor $R_1$ and resistor $R_2$.

Power supply control circuit 200 also comprises a switcher circuit 220. Switcher circuit 220 comprises a PMOS transistor $M_2$, an NMOS transistor $M_3$, an $I_{SWITCHER}$ current probe 250, a gate driver with dead time control 260, and a switcher control circuit 270. As shown in FIG. 2, the switcher circuit 220 is inductively coupled to low drop out (LDO) circuit 210 through an inductor L. Inductor L is coupled to a point that is located between $I_{SWITCHER}$ current probe 250 and NMOS transistor $M_3$.

The drain of PMOS transistor $M_2$ is coupled to the operating voltage $V_{BATT}$. The gate of PMOS transistor $M_2$ is coupled to a first output of gate driver with dead time control 260. The source of PMOS transistor $M_2$ is coupled to a first end of $I_{SWITCHER}$ current probe 250. The $I_{SWITCHER}$ current probe 250 detects and measures the current that is present in the source of PMOS transistor $M_2$.

The second end of $I_{SWITCHER}$ current probe 250 is coupled to the drain of NMOS transistor $M_3$. The gate of PMOS transistor $M_3$ is coupled to a second output of gate driver with dead time control 260. The source of NMOS transistor $M_3$ is coupled to ground.

As shown in FIG. 2, an output of switcher control circuit 270 is provided to an input of gate driver with dead time control 260. Switcher control circuit 270 receives an $I_{LDO}$ signal from the $I_{LDO}$ current probe 240. Switcher control circuit 270 also receives an $I_{SWITCHER}$ signal from the $I_{SWITCHER}$ current probe 250. Switcher control circuit 270 uses the $I_{LDO}$ signal and the $I_{SWITCHER}$ signal to create a voltage control signal (designated $V_{CON_SW}$) for controlling the operation of gate driver with dead time control 260. Gate driver with dead time control 260 controls the operation of PMOS transistor $M_2$ and NMOS transistor $M_3$ by applying a control voltage signal to the gate of PMOS transistor $M_2$ and by applying a control voltage signal to the gate of NMOS transistor $M_3$.

The power supply circuit 200 that is shown in FIG. 2 provides a power control signal that has high efficiency and a wide bandwidth. The wide bandwidth is provided by the low drop out circuit 210 and the high efficiency is provided by the switcher circuit 220. As previously described, the operation of the switcher control circuit 270 is regulated by the $I_{LDO}$ signal from $I_{LDO}$ current probe 240 (i.e., the current present in the source of PMOS transistor $M_1$) and the $I_{SWITCHER}$ signal from $I_{SWITCHER}$ current probe 250 (i.e., the current present in the source of PMOS transistor $M_2$).

Figure 3:
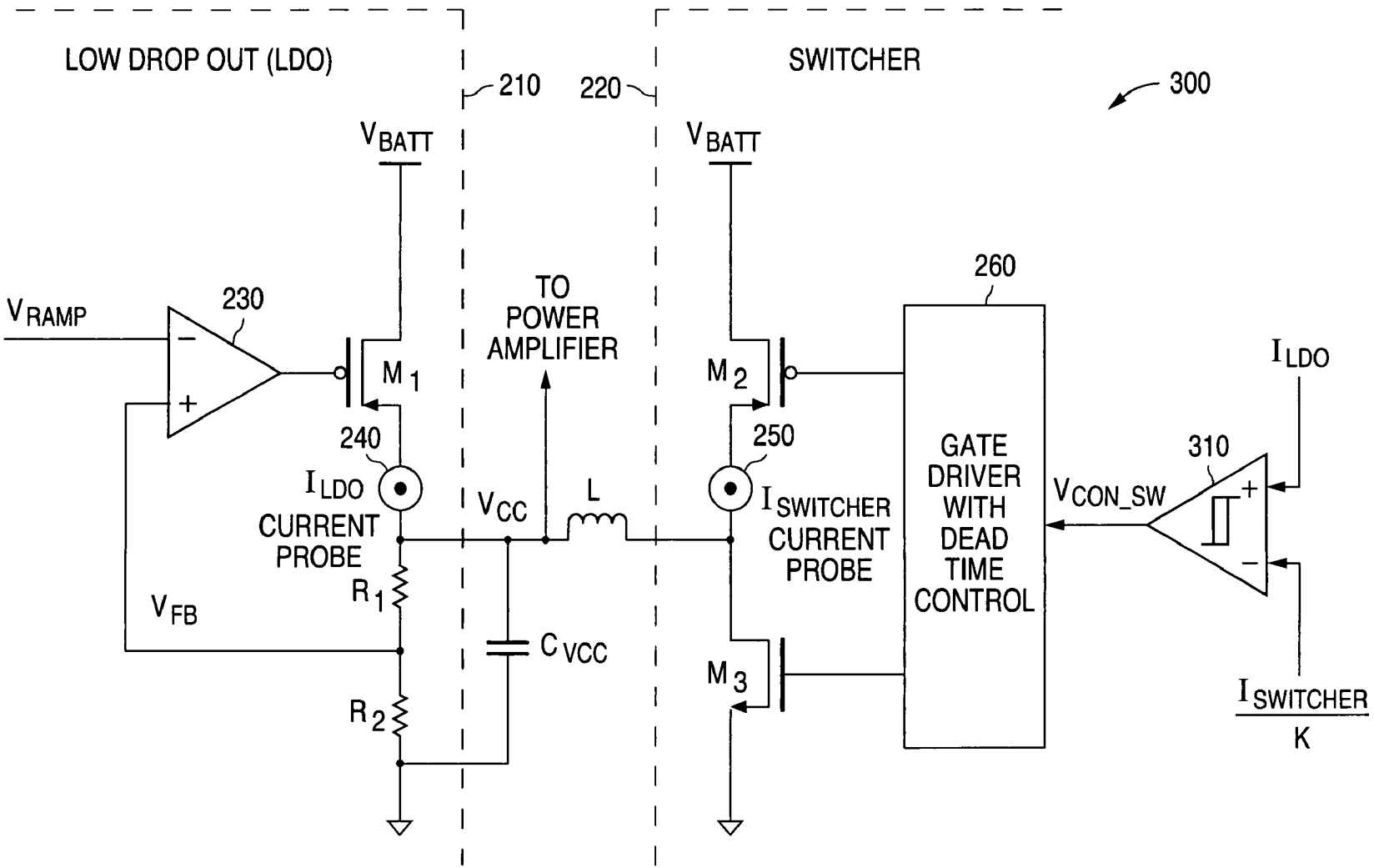
FIG. 3 illustrates a schematic diagram of a second embodiment of a combination of a low drop out circuit and a switcher circuit in accordance with the principles of the present invention using hysteretic current mode control.

FIG. 3 illustrates a schematic diagram of a second embodiment of a power supply control circuit 300 comprising a low drop out circuit 210 and a switcher circuit 220 in accordance with the principles of the present invention. In power supply control circuit 300 the switch control unit utilizes hysteretic current mode control. Except for the differences described below, the operation of the low drop out circuit 210 and the switcher circuit 220 of power supply control circuit 300 is the same as the operation of the first embodiment shown in FIG. 2.

The switch control unit comprises a current comparator circuit 310. Current comparator circuit 310 receives two inputs. The first input is the $I_{LDO}$ signal from $I_{LDO}$ current probe 240 and the second input is a scaled $I_{SWITCHER}$ signal. The scaled $I_{SWITCHER}$ signal is the $I_{SWITCHER}$ signal from $I_{SWITCHER}$ current probe 250 that has been divided by a scale factor K. The scale factor K is provided to establish the ratio of $I_{SWITCHER}$ signal and the $I_{LDO}$ signal in the steady state so that the switcher circuit 220 will provide K times the current provided by the $I_{LDO}$ current.

In this manner the majority of the current is provided by the switcher circuit 220 to achieve overall high efficiency. The output to track the $V_{ramp}$ signal is provided by the low drop out (LDO) circuit 210. In the switcher circuit 220 of power supply control circuit 300 the PMOS transistor $M_2$ will turn "on" and the NMOS transistor $M_3$ Will turn "off" when the $I_{SWITCHER}/K$ signal is less than the $I_{LDO}$ signal. The PMOS transistor $M_2$ will turn "off" and the NMOS transistor $M_3$ Will turn "on" when the $I_{SWITCHER}/K$ signal is greater than the $I_{LDO}$ signal. The switching frequency of the current comparator circuit 310 is varying depending upon the current comparator hysteresis and the loop delay elements.

Figure 4:
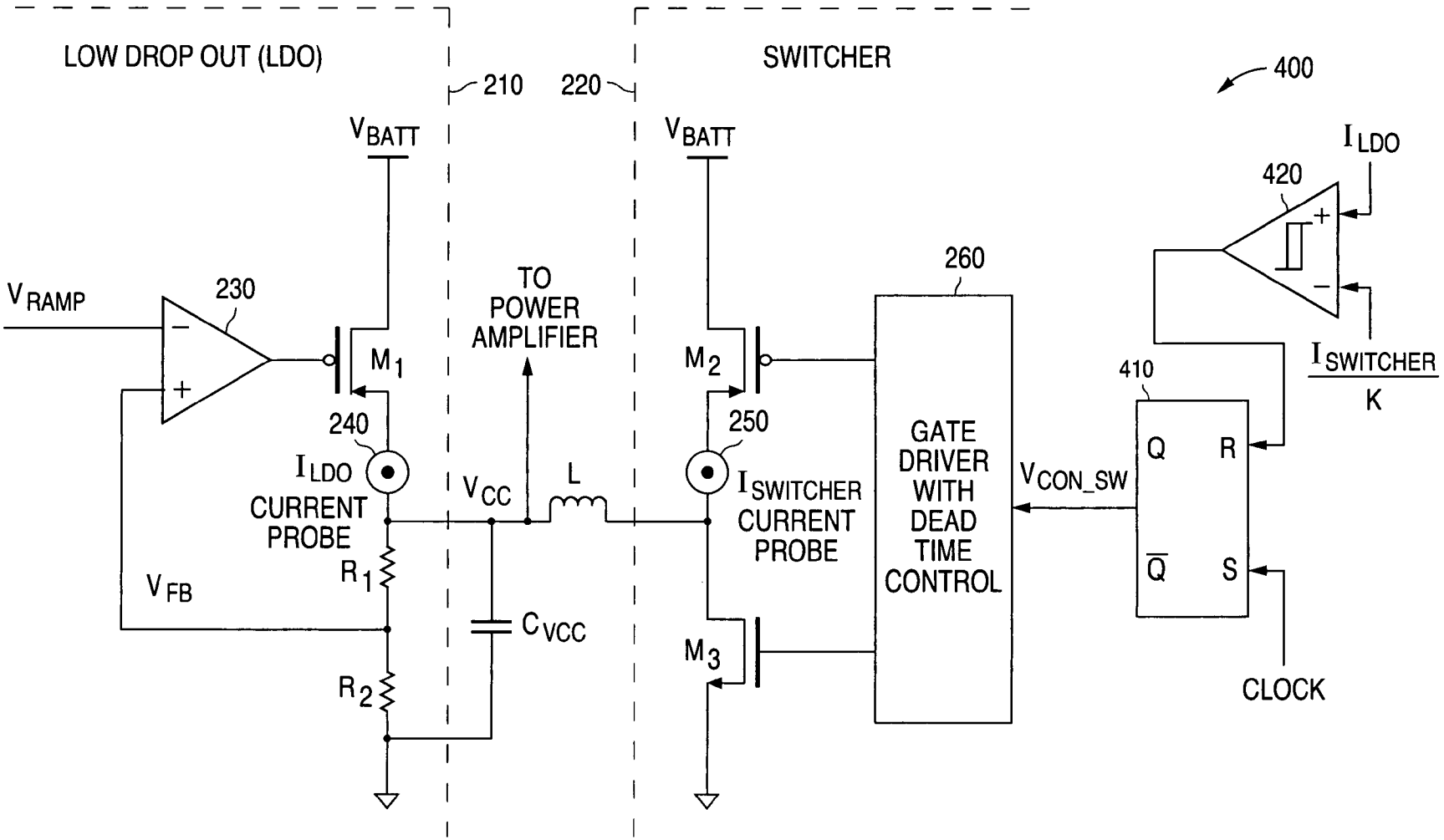
FIG. 4 illustrates a schematic diagram of a third embodiment of a combination of a low drop out circuit and a switcher circuit in accordance with the principles of the present invention using pulse width modulation (PWM) current mode control.

FIG. 4 illustrates a schematic diagram of a third embodiment of a power supply control circuit 400 comprising a low drop out circuit 210 and a switcher circuit 220 in accordance with the principles of the present invention. In power supply control circuit 400 the switch control unit utilizes pulse width modulation (PWM) current mode control. Except for the differences described below, the operation of the low drop out circuit 210 and the switcher circuit 220 of power supply control circuit 400 is the same as the operation of the first embodiment shown in FIG. 2.

The switching circuit 220 comprises a R-S flip flop circuit 410 and a current comparator circuit 420. The operation of the current comparator circuit 420 is the same as the operation that has been previously described for the current comparator circuit 310 of FIG. 3. The output of current comparator circuit 420 is provided to the reset (R) input of flip flop circuit 410. A clock signal is provided to the set (S)

input of flip flop circuit 410. The switching frequency of switcher circuit 220 is set by the frequency of the clock signal.

In the switcher circuit 220 of power supply control circuit 400 the PMOS transistor $M_2$ is turned "on" and the NMOS transistor $M_3$ is turned "off" by the clock pulse. The PMOS transistor $M_2$ is turned "off" and the NMOS transistor $M_3$ is turned "on" when the $I_{SWITCHER}/K$ signal is greater than the $I_{LDO}$ signal.

Figure 5A:
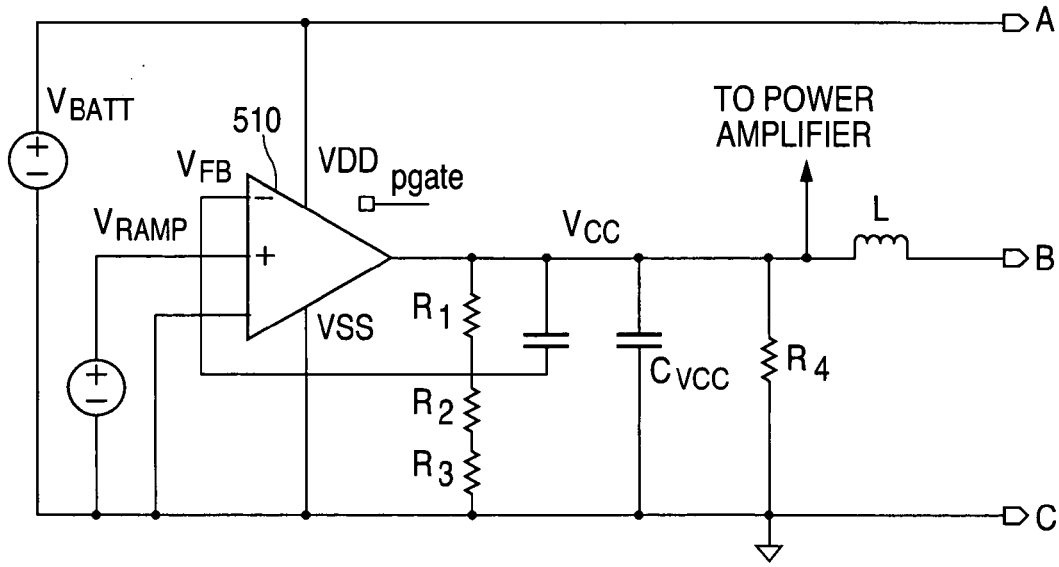
FIG. 5A illustrates a schematic diagram of a first embodiment of a low drop out circuit in accordance with the principles of the present invention using pulse width modulation (PWM) current mode control.
Figure 5B:
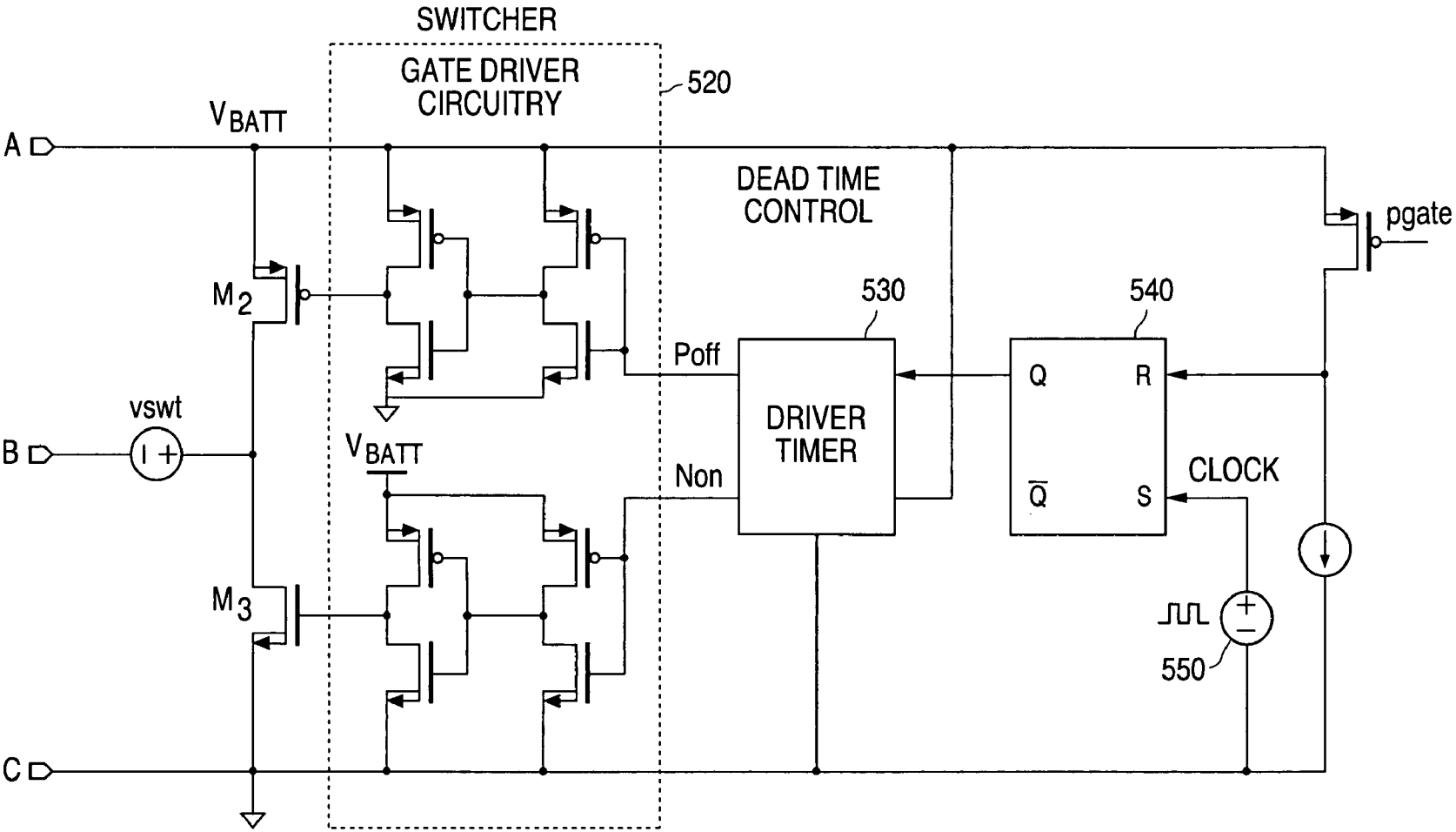
FIG. 5B illustrates a schematic diagram of a first embodiment of a switcher circuit in accordance with the principles of the present invention for use with the low drop out circuit shown in FIG. 5A using pulse width modulation (PWM) current mode control.

The operation of power supply control circuit 400 may be modeled with the low drop out (LDO) circuit shown in FIG. 5A and the switcher circuitry shown in FIG. 5B. FIG. 5A and FIG. 5B are designed to be viewed together. The terminals designated A, B, and C in FIG. 5A connect to the respective terminals designated A, B, and C in FIG. 5B.

The low drop out (LDO) circuit in FIG. 5A comprises operational amplifier 510. The output of operational amplifier 510 provides the power amplifier (PA) power supply voltage $V_{CC}$ to a radio frequency (RF) power amplifier (PA) (not shown in FIG. 5A).

The switcher circuitry in FIG. 5B comprises PMOS transistor $M_2$, NMOS transistor $M_3$, gate driver circuitry 520, driver timer 530, R-S flip flop circuit 540, and clock 550.

Figure 6A:
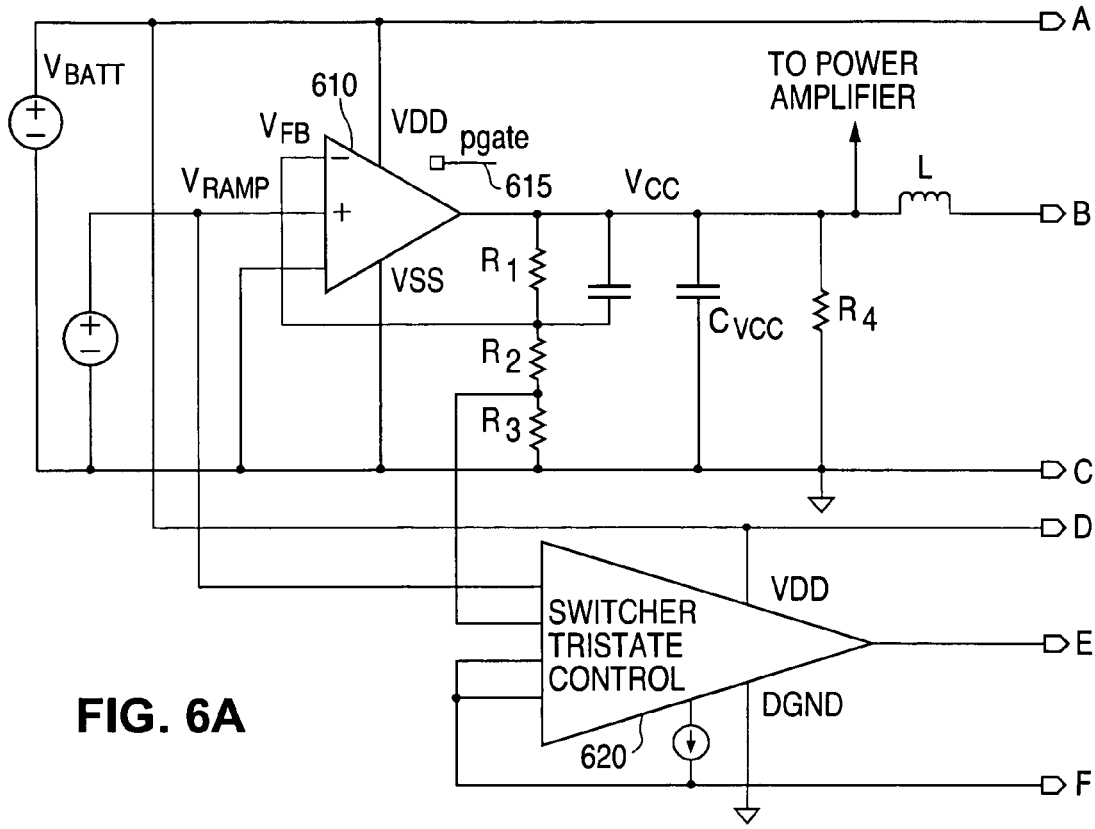
FIG. 6A illustrates a schematic diagram of a second embodiment of a low drop out circuit in accordance with the principles of the present invention using pulse width modulation (PWM) current mode control.
Figure 6B:
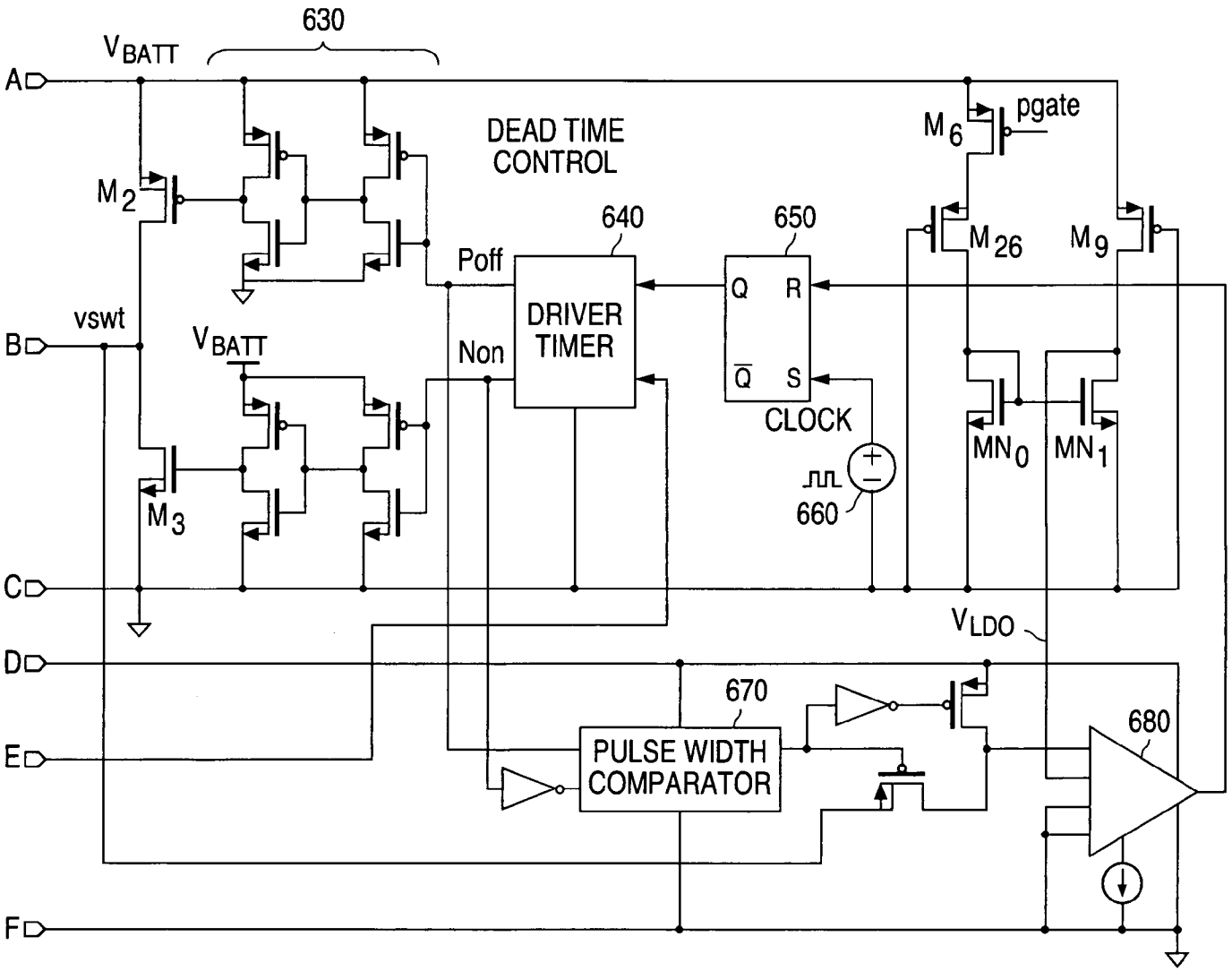
FIG. 6B illustrates a schematic diagram of a second embodiment of a switcher circuit in accordance with the principles of the present invention for use with the low drop out circuit shown in FIG. 6A using pulse width modulation (PWM) current mode control.

Implementation details of power supply control circuit 400 are shown in the low drop out (LDO) circuit shown in FIG. 6A and in the switcher circuitry shown in FIG. 6B. FIG. 6A and FIG. 6B are designed to be viewed together. The terminals designated A, B, C, D, E and F in FIG. 6A connect to the respective terminals designated A, B, C, D, E and F in FIG. 6B.

The low drop out (LDO) circuit in FIG. 6A comprises operational amplifier 610. The output of operational amplifier 610 provides the power amplifier (PA) power supply voltage $V_{CC}$ to a radio frequency (RF) power amplifier (PA) (not shown in FIG. 6A). In this embodiment the low drop out (LDO) PMOS transistor $M_1$ is located at the output of the operational amplifier 610. The gate of PMOS transistor M1 is shown in FIG. 6A as "pgate" terminal 615. The low drop out (LDO) circuit in FIG. 6A also comprises a switcher tristate control unit 620.

The switcher circuitry in FIG. 6B comprises PMOS transistor $M_2$, NMOS transistor $M_3$, gate driver circuitry 630, driver timer 640, R-S flip flop circuit 650, clock 660, pulse width comparator unit 670, and comparator circuit 680.

The low drop out (LDO) current ($I_{LDO}$) is sensed by a current mirror that is formed by LDO PMOS transistor $M_1$ (within operational amplifier 610) and PMOS transistor $M_6$ (with the signal "pgate" at their respective gates). That is, the gate of PMOS transistor $M_6$ is coupled to the "pgate" terminal 615 that is connected to the gate of PMOS transistor $M_1$ within operational amplifier 610. The $I_{LDO}$ current is mirrored by the current mirror formed by NMOS transistor $MN_0$ and NMOS transistor $MN_1$. The $I_{LDO}$ current is converted to a voltage signal $V_{LDO}$ by the switch resistance of PMOS transistor $M_9$. The voltage signal $V_{LDO}$ is provided to an input of comparator circuit 680.

The voltage that is present at the switcher switching node "vswt" when the switcher PMOS transistor M2 is "on" (and after a certain blanking time has elapsed to prevent false triggering) is also provided to an input of comparator circuit 680. Comparator 680 compares the voltage signals in order to determine whether the $I_{SWITCHER}/K$ current is greater than or less than the $I_{LDO}$ current. The factor K is achieved by appropriately selecting the device size ratio of switcher PMOS transistor $M_2$ to PMOS transistor $M_9$, and the device size ratio of NMOS transistor $MN_0$ to NMOS transistor $MN_1$, and the device size ratio of LDO PMOS transistor $M_1$ to PMOS transistor $M_6$.

Another feature of the embodiment of the invention shown in FIG. 6A is the switcher tristate control unit 620. The output of switcher tristate control unit 620 is coupled to an input of the driver timer 640 (through terminal E). The switcher tristate control unit 620 operates when the LDO loop is open during the $V_{CC}$ ramp down. During the $V_{CC}$ ramp down the current in the LDO PMOS transistor $M_1$ quickly becomes zero. Then the switcher NMOS transistor $M_3$ will be "on" to ramp down the inductor current.

The inductor current would decrease more quickly if NMOS diode is "on" instead of the channel because of the forward diode voltage drop. The $V_{CC}$ ramp down in this case is sensed by a slightly different tap from a $V_{CC}$ feedback voltage network that indicates that $V_{CC}$ is above the desired value.

Figure 7A:
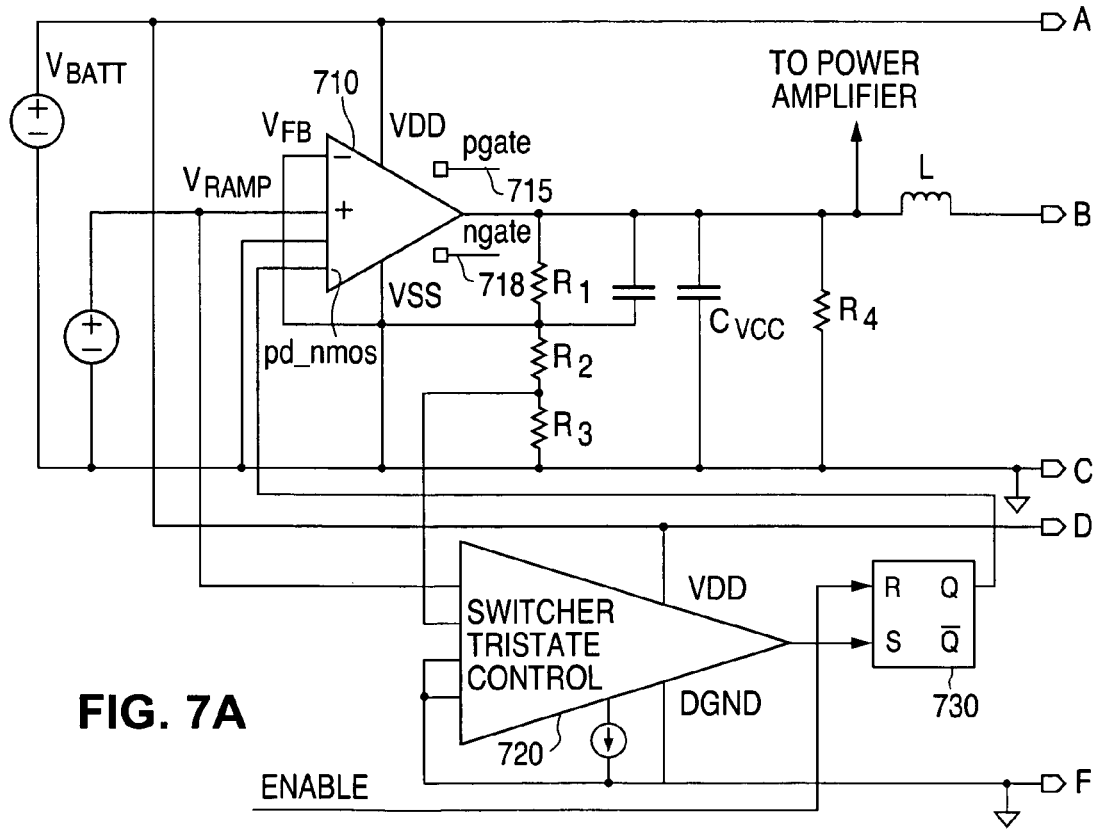
FIG. 7A illustrates a schematic diagram of a third embodiment of a low drop out circuit in accordance with the principles of the present invention using pulse width modulation (PWM) current mode control.
Figure 7B:
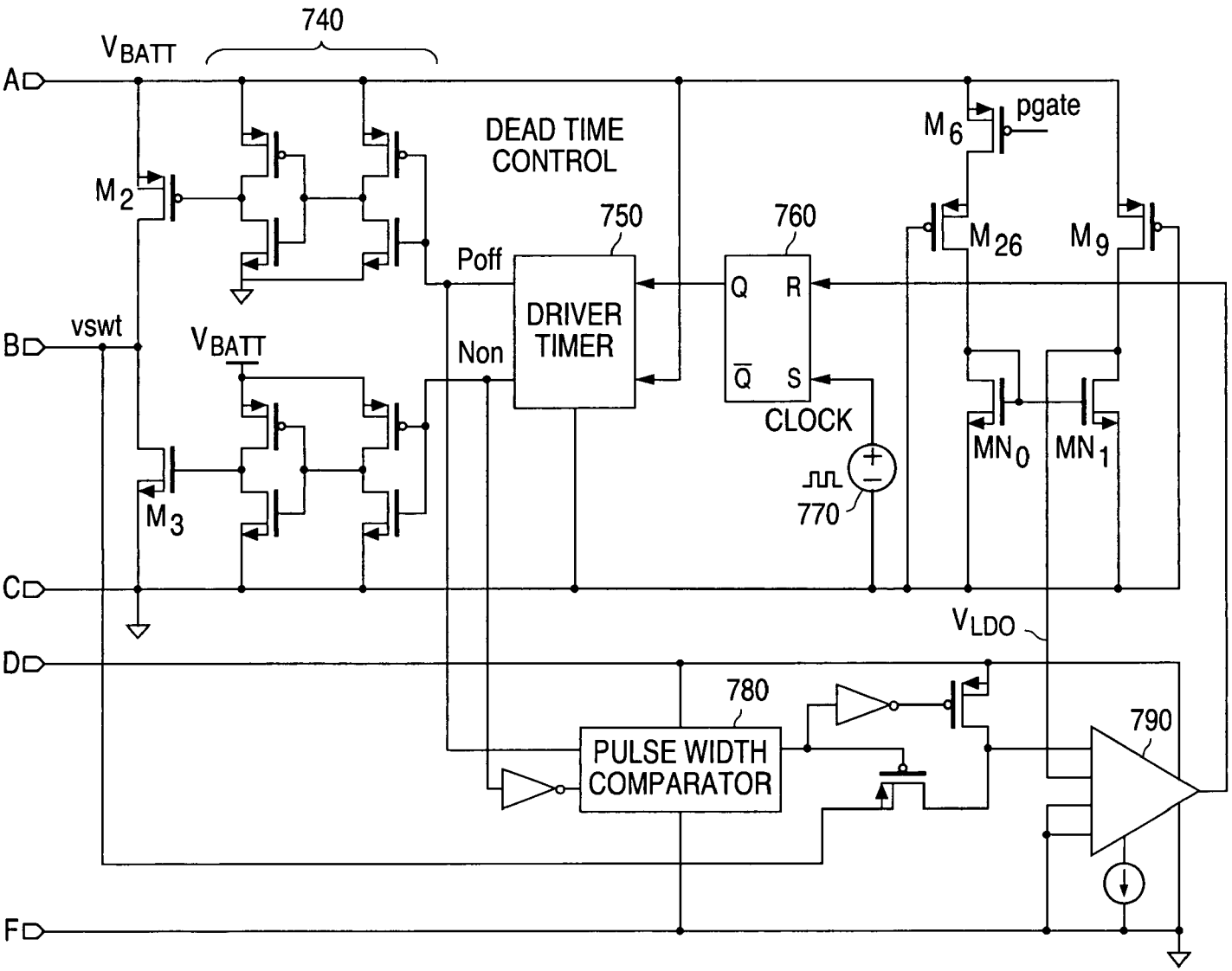
FIG. 7B illustrates a schematic diagram of a third embodiment of a switcher circuit in accordance with the principles of the present invention for use with the low drop out circuit shown in FIG. 7A using pulse width modulation (PWM) current mode control.

For a case in which the $V_{CC}$ ramp down is required to track $V_{ramp}$ to a high degree of accuracy, the switcher tristate control unit 620 may not be sufficient. The embodiment of the invention illustrated in FIG. 7A and in FIG. 7B shows one exemplary method for controlling the $V_{CC}$ ramp down actively with a class-AB amplifier. FIG. 7A and FIG. 7B are designed to be viewed together. The terminals designated A, B, C, D and F in FIG. 7A connect to the respective terminals designated A, B, C, D and F in FIG. 7B.

The low drop out (LDO) circuit in FIG. 7A comprises class AB operational amplifier 710. The output of operational amplifier 710 provides the power amplifier (PA) power supply voltage $V_{CC}$ to a radio frequency (RF) power amplifier (PA) (not shown in FIG. 7A). In this embodiment the low drop out (LDO) PMOS transistor $M_1$ is located at the output of the operational amplifier 710. The gate of PMOS transistor M1 is shown in FIG. 7A as "pgate" terminal 715. In this embodiment a low drop out (LDO) NMOS transistor is also located at the output of the operational amplifier 710. The gate of the low drop out (LDO) NMOS transistor is shown in FIG. 7A as "ngate" terminal 718. The low drop out (LDO) circuit in FIG. 7A also comprises a switcher tristate control unit 720 and a R-S flip flop circuit 730.

The switcher circuitry in FIG. 7B comprises PMOS transistor $M_2$, NMOS transistor $M_3$, gate driver circuitry 740, driver timer 750, R-S flip flop circuit 760, clock 770, pulse width comparator unit 780, and comparator circuit 790.

The operation of the embodiment shown in FIG. 7A and in FIG. 7B is the same as the operation of the embodiment shown in FIG. 6A and in FIG. 6B except for the modifications described below. Unlike the switcher tristate control unit 620 of FIG. 6A, the output of switcher tristate control unit 720 is coupled to an S input of an R-S flip flop circuit 730. An enable signal is coupled to the R input of the flip flop circuit 730. The output of flip flop circuit 730 is coupled to an input of the class AB operational amplifier 710.

The LDO NMOS transistor that has its gate coupled to the "ngate" output terminal 718 of the class AB operational amplifier 710 will be active only when necessary to reduce the current consumption. During normal operation this NMOS transistor will be turned "off" by the signal "pd_nmos" from the R-S flip flop circuit 730 and the class AB operational amplifier 710 will operate as an LDO. The NMOS transistor that has its gate coupled to the "ngate" output terminal of the class AB operational amplifier 710 will be activated (i.e., turned "on") if the $V_{CC}$ voltage signal is not tracking the $V_{ramp}$ voltage.

The embodiment shown in FIG. 7A and in FIG. 7B only demonstrates the case in which the value of voltage $V_{CC}$ is too high. The circuitry of the present invention can be modified to handle the case in which the value of voltage $V_{CC}$ is too low. For example, another tap can be added and multiplexed to the comparator circuit 790.

The PMOS transistor $M_1$ within the class AB operational amplifier 710 (that has its gate coupled to the "pgate" output terminal 715) could also be turned "off" in a similar way as the NMOS transistor that has its gate coupled to the "ngate" output terminal 718 of the class AB operational amplifier 710 during the $V_{CC}$ ramp down after the NMOS transistor has been activated to sink the current. This approach will save unnecessary quiescent current.

Although the embodiment of the invention shown in FIG. 7A and in FIG. 7B is primarily intended for use with a GSM power amplifier (PA), it is understood that the various embodiments of the invention could also be applied to other applications that demand wide bandwidth or signal tracking (as long as the current in the LDO PMOS transistor $M_1$ is not zero to keep the LDO loop closed).

Another embodiment of the concept shown in FIG. 2 that combines an LDO and a switcher circuit involves using a switcher control circuit 270 that operates with a "constant on" time period or with a "constant off" time period. In the "constant on" time current control mode, the LDO PMOS transistor $M_1$ is turned on when the value of $I_{SWITCHER}/K$ is less than the value of $I_{LDO}$ and the LDO PMOS transistor $M_1$ is then kept "on" for a designated constant time period. After the designated constant time period has expired, the LDO PMOS transistor $M_1$ is kept "off" until the value of $I_{SWITCHER}/K$ is less than the value $I_{LDO}$ again.

In a similar fashion, in the "constant off" time current control mode, the LDO PMOS transistor $M_1$ is kept "on" until the value of $I_{SWITCHER}/K$ is greater than the value of $I_{LDO}$. Then the LDO PMOS transistor $M_1$ is kept "off" for a designated constant time period. After the designated constant time period has expired, the LDO PMOS transistor $M_1$ is kept "on" until the value of $I_{SWITCHER}/K$ is greater than the value $I_{LDO}$ again.

Figure 8:
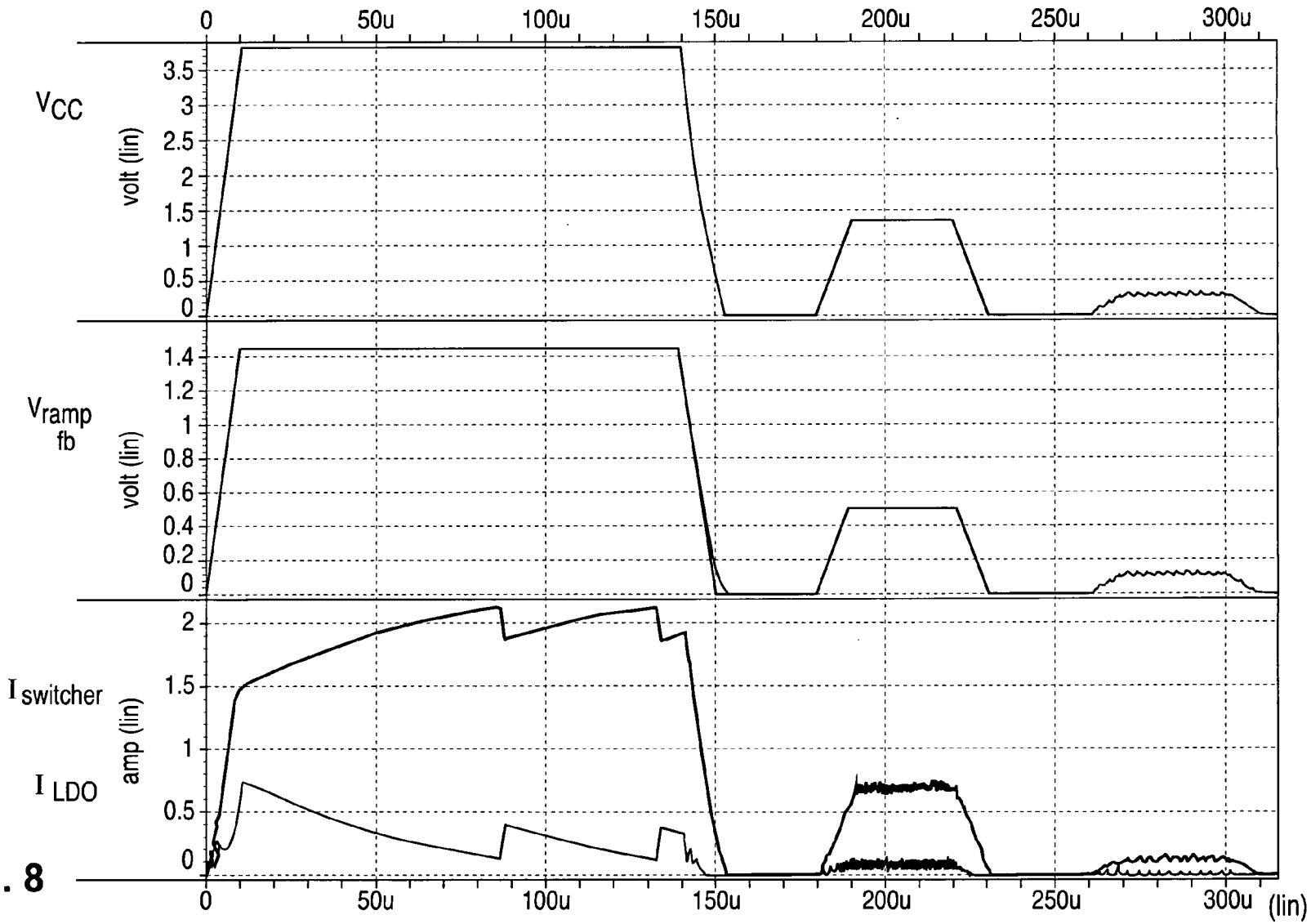
FIG. 8 illustrates a graph showing waveforms of some of the signals that are present in the embodiment of the invention that is shown in FIG. 7A and in FIG. 7B.

FIG. 8 illustrates a graph showing waveforms of some of the signals that are present in the embodiment of the invention that is shown in FIG. 7A and in FIG. 7B. The top graph shows a waveform showing the value of the supply voltage $V_{CC}$ over time. The middle graph shows a waveform showing the value of the $V_{ramp}$ voltage over time. The lower graph shows a waveform showing the value of the $I_{SWITCHER}$ current and the $I_{LDO}$ current over time.

The $V_{ramp}$ signal is ramped up and down in ten microseconds (10 μs) with steady state values of one and three tenths volts (1.3 V), five tenths of a volt (0.5 V) and one tenth of a volt (0.1 V) to represent the different power requirements. It can be seen from the graphs that the power supply VCC is able to tract the $V_{ramp}$ signal very well.

An important feature that also may be seen from the graphs is that the $I_{SWITCHER}$ current provides most of the current for the load. For the case of the light load condition (where $V_{ramp}$ equals one tenth of a volt (0.1 V)) the power supply $V_{CC}$ has a relatively larger ripple because the LDO is open loop once its PMOS transistor current reaches zero. In this case, the class AB amplifier approach illustrated in FIG. 7A and in FIG. 7B will do a better job.

The values of the $V_{ramp}$ voltage signal and the load current ($I_{LOAD}$) are compared in Table One below.

TABLE ONE

| $V_{ramp}$ (Volts) | $I_{LOAD}$ (mA) | LDO efficiency | LDO + Switcher efficiency |
|---|---|---|---|
| 1.3 | 2255 | 91% | 93% |
| 0.5 | 777 | 31% | 74% |
| 0.1 | 156 | 6% | 38% |

It may be seen from Table One that the combination of the LDO and the switcher circuit of the present invention has much better efficiency than that of the LDO alone.

Figure 9:
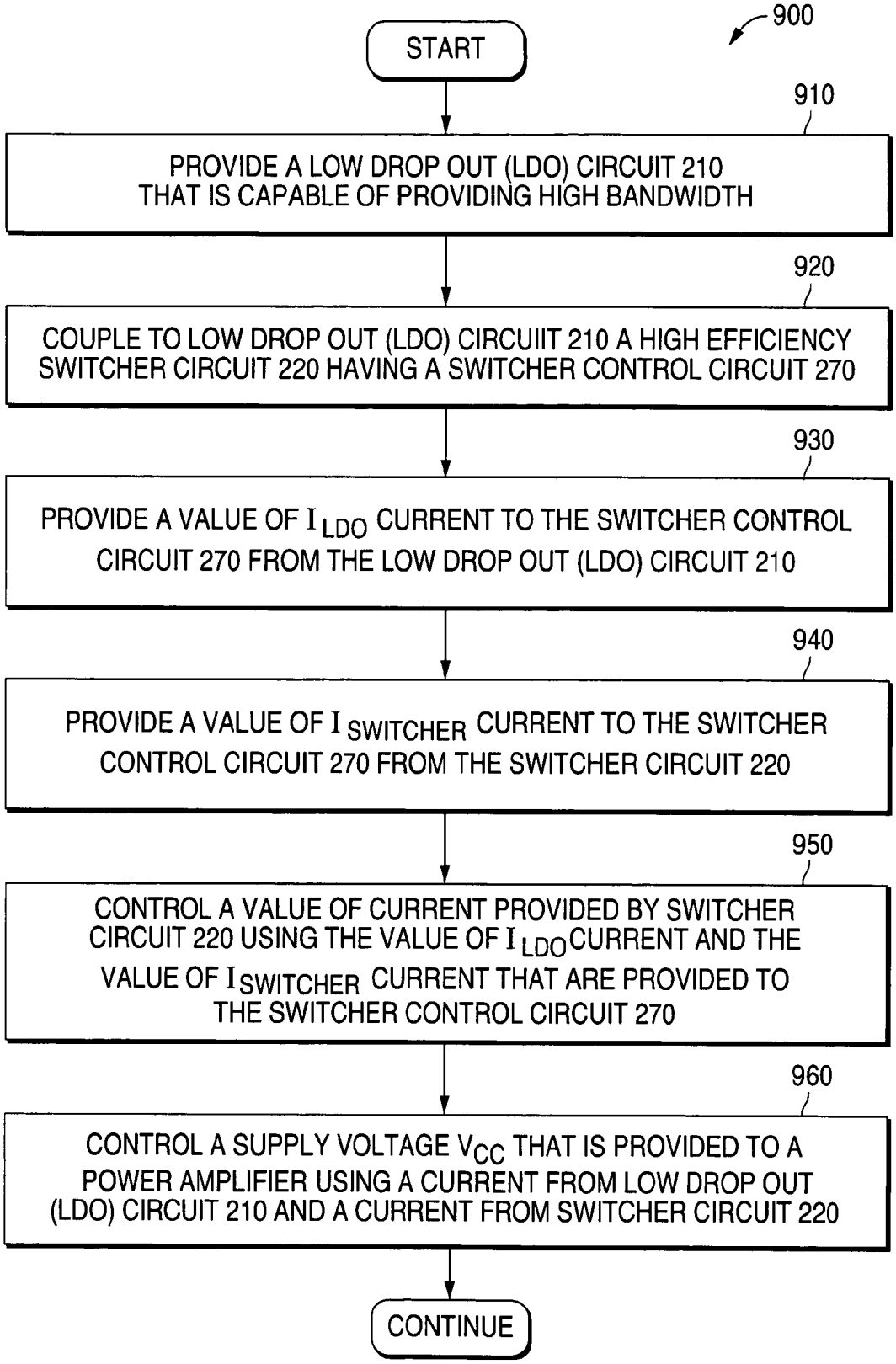
FIG. 9 illustrates a flow chart showing the steps of an advantageous embodiment of the method of the present invention.

FIG. 9 illustrates a flow chart showing the steps 900 of an advantageous embodiment of the method of the present invention. In the first step a low drop out (LDO) circuit 210 is provided that is capable of providing high bandwidth (step 910). Then a high efficiency switcher circuit 220 having a switcher control circuit 270 is coupled to the low drop out (LDO) circuit 210 (step 920). Then a value of $I_{LDO}$ current from the low drop out (LDO) circuit 210 is provided to the switcher control circuit 270 (step 930). Then a value of $I_{SWITCHER}$ current from the switcher circuit 220 is provided to the switcher control circuit 270 (step 940).

The value of the $I_{LDO}$ current and the value of the $I_{SWITCHER}$ current that are provided to the switcher control circuit 270 are the used to control a value of current that is provided by the switcher circuit 220 (step 950). Then the current from the low drop out (LDO) circuit 210 and the current from the switcher circuit 220 are then used to control a supply voltage $V_{CC}$ to a power amplifier (step 960).

Although the present invention has been described with an exemplary embodiment, various changes and modifications may be suggested to one skilled in the art. It is intended that the present invention encompass such changes and modifications as fall within the scope of the appended claims.

What is claimed is:

1. A power supply control circuit comprising:

a low drop out circuit that outputs a first value of current ($I_{LDO}$);

a switcher circuit coupled to said low drop out circuit wherein said switcher circuit outputs a second value of current ($I_{SWITCHER}$); and an inductor wherein an output of said low drop out circuit is coupled to a first end of said inductor and an output of said switcher circuit is coupled to a second end of said inductor;

wherein said power supply control circuit provides power to a power amplifier from a node located between said output of said low drop out circuit and said first end of said inductor.

2. The power supply control circuit as set forth in claim 1 wherein said switcher circuit comprises a switcher control circuit that controls a value of said $I_{SWITCHER}$ current that is provided as an output by said switcher circuit.

3. The power supply control circuit as set forth in claim 2 further comprising an $I_{SWITCHER}$ current probe in said switcher circuit that provides a value of said $I_{SWITCHER}$ current to an $I_{SWITCHER}$ input of said switcher control circuit.

4. The power supply control circuit as set forth in claim 3 further comprising an $I_{LDO}$ current probe in said low drop out circuit that provides said value of $I_{LDO}$ current to an $I_{LDO}$ input of said switcher control circuit.

5. A power supply control circuit comprising:

a low drop out circuit that outputs a first value of current ($I_{LDO}$);

a switcher circuit coupled to said low drop out circuit wherein said switcher circuit outputs a second value of current ($I_{SWITCHER}$);

wherein said switcher circuit comprises a switcher control circuit that controls a value of said $I_{SWITCHER}$ current that is provided as an output by said switcher circuit;

an $I_{SWITCHER}$ current probe in said switcher circuit that provides a value of said $I_{SWITCHER}$ current to an $I_{SWITCHER}$ input of said switcher control circuit;

an $I_{LDO}$ current probe in said low drop out circuit that provides said value of $I_{LDO}$ current to an $I_{LDO}$ input of said switcher control circuit;

a PMOS transistor in said switcher circuit having a drain coupled to an operating voltage and having a source coupled to a first end of said $I_{SWITCHER}$ current probe; and an NMOS transistor in said switcher circuit having a drain coupled to a second end of said $I_{SWITCHER}$ current probe and a source coupled to ground.

6. The power supply control circuit as set forth in claim 5 further comprising a gate driver with dead time control wherein an input of said gate driver with dead time control is coupled to an output of said switcher control circuit;

wherein a first output of said gate driver with dead time control is coupled to a gate of said PMOS transistor; and wherein a second output of said gate driver with dead time control is coupled to a gate of said NMOS transistor.

7. The power supply control circuit as set forth in claim 6 wherein said switcher control circuit utilizes hysteretic current mode control.

8. The power supply control circuit as set forth in claim 7 wherein said switcher control circuit comprises a current comparator circuit wherein said comparator circuit comprises a first input that receives an $I_{LDO}$ signal from said $I_{LDO}$ current probe; and wherein said comparator circuit comprises a second input that receives a scaled $I_{SWITCHER}$ signal that comprises an $I_{SWITCHER}$ signal from said $I_{SWITCHER}$ current probe that has been scaled by a scale factor K to cause said switcher circuit to provide a current that is K times the $I_{LDO}$ current that is provided by said low drop out circuit.

9. The power supply control circuit as set forth in claim 8 wherein said PMOS transistor turns on and said NMOS transistor turns off when a value of said scaled $I_{SWITCHER}$ signal is less than a value of said $I_{LDO}$ signal; and wherein said PMOS transistor turns off and said NMOS transistor turns on when a value of said scaled $I_{SWITCHER}$ signal is greater than a value of said $I_{LDO}$ signal.

10. The power supply control circuit as set forth in claim 6 wherein said switcher control circuit utilizes pulse width modulation current mode control.

11. The power supply control circuit as set forth in claim 10 wherein said switcher control circuit comprises:

a current comparator circuit; and an R-S flip flop circuit having an output coupled to an input of said gate driver with dead time control;

wherein a first input of said R-S flip flop circuit is coupled to a clock signal; and wherein a second input of said R-S flip flop circuit is coupled to an output of said current comparator circuit;

wherein said comparator circuit comprises a first input that receives an $I_{LDO}$ signal from said $I_{LDO}$ current probe; and wherein said comparator circuit comprises a second input that receives a scaled $I_{SWITCHER}$ signal that comprises an $I_{SWITCHER}$ signal from said $I_{SWITCHER}$ current probe that has been scaled by a scale factor K to cause said switcher circuit to provide a current that is K times the $I_{LDO}$ current that is provided by said low drop out circuit.

12. The power supply control circuit as set forth in claim 11 wherein said PMOS transistor is turned on and said NMOS transistor is turned off by a clock pulse received by said R-S flip flop circuit; and wherein said PMOS transistor turns off and said NMOS transistor turns on when a value of said scaled $I_{SWITCHER}$ signal is greater than a value of said $I_{LDO}$ signal.

13. A power supply control circuit comprising:

a low drop out circuit that outputs a first value of current ($I_{LDO}$) wherein said low drop out circuit comprises an operational amplifier that provides a power supply voltage $V_{CC}$; and a switcher circuit coupled to said low drop out circuit wherein said switcher circuit outputs a second value of current ($I_{SWITCHER}$) wherein said switcher circuit comprises a PMOS transistor, an NMOS transistor, gate driver circuitry, a driver timer, an R-S flip flop circuit, and a clock circuit.

14. The power supply control circuit as set forth in claim 13 wherein said low drop out circuit further comprises a switcher tristate control circuit unit having an output that is coupled to an input of said driver timer;

wherein said switcher tristate control unit is operable to turn on said PMOS transistor in said switcher circuit when a low drop out (LDO) loop is open during a $V_{CC}$ ramp down process.

15. The power supply control circuit as set forth in claim 14 wherein said switcher circuit further comprises a pulse width comparator unit and a comparator circuit;

wherein said comparator circuit compares a voltage signal $V_{LDO}$ that represents a value of $I_{LDO}$ current with a voltage signal that represents a value of voltage that is present at said PMOS transistor when said PMOS transistor is on in order to determine whether said scaled $I_{SWITCHER}$ current is greater than or less than said $I_{LDO}$ current.

16. The power supply control circuit as set forth in claim 15 wherein said operational amplifier that provides a power supply voltage $V_{CC}$ comprises a class AB amplifier; and wherein said low drop out circuit comprises a R-S flip flop circuit having a first input that is coupled to an output of said switcher tristate control circuit and a second input that is coupled to an enable signal line; and wherein an output of said R-S flip flop circuit is coupled to an input of said class AB amplifier;

wherein an operation of said R-S flip flop circuit turns on an NMOS transistor at the output of said class AB amplifier when a value of power supply voltage $V_{CC}$ does not track a value of $V_{ramp}$ voltage that is provided to said class AB amplifier.

17. The power supply control circuit as set forth in claim 13 wherein said switcher circuitry comprises a switcher control circuit that operates using one of: a "constant on" time period and a "constant off" time period.

18. A method for providing a power supply control circuit, said method comprising the steps of:

providing a low drop out circuit that is capable of providing high bandwidth;

coupling to said low drop out circuit a high efficiency switcher circuit that comprises a switcher control circuit;

providing a first value of current ($I_{LDO}$) to said switcher control circuit from said low drop out circuit; and providing a second value of current ($I_{SWITCHER}$) to said switcher control circuit from said switcher circuit.

19. The method as set forth in claim 18 further comprising the steps of:

controlling a value of current provided by said switcher circuit using said first value of current ($I_{LDO}$) from said low drop out circuit and said second value of current ($I_{SWITCHER}$) from said switcher circuit that are provided to said switcher control circuit; and controlling a value of power supply voltage $V_{CC}$ using a current from said low drop out circuit and a current from said switcher circuit; and providing said controlled value of power supply voltage $V_{CC}$ to a power amplifier.

* * * * *